US011761597B1

(12) United States Patent
Zheng

(10) Patent No.: US 11,761,597 B1
(45) Date of Patent: Sep. 19, 2023

(54) DOWNLIGHT WITH MULTIPLE ANGLES

(71) Applicant: Hongbing Zheng, Hangzhou (CN)

(72) Inventor: Hongbing Zheng, Hangzhou (CN)

(73) Assignee: ZHENG, Hongbing, Zhejiang (CN)

( * ) Notice: Subject to any disclaimer, the term of this patent is extended or adjusted under 35 U.S.C. 154(b) by 0 days.

(21) Appl. No.: 17/971,659

(22) Filed: Oct. 24, 2022

(30) Foreign Application Priority Data

May 7, 2022 (CN) ..... 202210495394.7

(51) Int. Cl.

| | |
|---|---|
| ***F21S 8/02*** | (2006.01) |
| ***F21V 21/04*** | (2006.01) |
| ***F21V 7/05*** | (2006.01) |
| ***F21V 5/00*** | (2018.01) |
| *F21Y 105/18* | (2016.01) |
| *F21Y 115/10* | (2016.01) |

(52) U.S. Cl.
CPC ..... *F21S 8/026* (2013.01); *F21V 5/00* (2013.01); *F21V 7/05* (2013.01); *F21V 21/049* (2013.01); *F21Y 2105/18* (2016.08); *F21Y 2115/10* (2016.08)

(58) Field of Classification Search
CPC .... F21S 8/026; F21V 5/00; F21V 7/05; F21V 21/049
See application file for complete search history.

(56) References Cited

U.S. PATENT DOCUMENTS

| | | | | |
|---|---|---|---|---|
| 10,415,799 | B1 * | 9/2019 | Grove | F21V 3/00 |
| 2007/0285921 | A1 * | 12/2007 | Zulim | F21V 23/04 362/240 |
| 2020/0191344 | A1 * | 6/2020 | Van Winkle | G02B 6/005 |
| 2021/0199275 | A1 * | 7/2021 | Lin | F21S 8/026 |
| 2021/0356097 | A1 * | 11/2021 | Vernier | F21S 8/026 |
| 2022/0120394 | A1 * | 4/2022 | Liu | F21V 23/005 |
| 2022/0202972 | A1 * | 6/2022 | Chen | F21V 23/003 |

* cited by examiner

*Primary Examiner* — Christopher E Dunay

(57) ABSTRACT

A downlight, comprising: a back cover; light source components, provided on an aluminum substrate; a surface ring, which is a transparent supporting component and supports the aluminum substrate so that the aluminum substrate can be fixed to the back cover, and is fastened to the back cover; a light diffusing cover, mounted on a bottom of the surface ring for transmitting light emitted from the light source components. In the downlight of the present disclosure, light is transmitted to a ring-shaped panel of the surface ring through a truncated cone structure of the surface ring, and is then transmitted out of the ring-shaped panel, to achieve light emission with a new angle, solving the problem that in conventional downlights, light can only be emitted from a single angle. The present disclosure improves the angle of light emission from the light source while also improving its light emission effect.

11 Claims, 4 Drawing Sheets

DOWNLIGHT WITH MULTIPLE ANGLES

CROSS REFERENCE TO RELATED APPLICATION

The present application claims the benefit of priority to Chinese Patent Application No. CN 2022104953947, entitled "A Novel Downlight", filed with CNIPA on May 7, 2022, the disclosure of which is incorporated herein by reference in its entirety for all purposes.

FIELD OF TECHNOLOGY

The present disclosure relates to the field of lighting technology, in particular, to a downlight with multiple angles.

BACKGROUND

An LED downlight is a lighting fixture embedded in a ceiling and lights in a downward direction. It is a hidden lighting fixture, and all the light is projected downward, which is direct illumination. Different reflectors, lenses, window-shades, and bulbs can be used to achieve different light effects. Downlights do not occupy much space, and can soften the atmosphere of the room; multiple downlights can be installed to create a warm feeling and reduce crowdedness. They are commonly used in hotels, homes, and coffee shops. Existing downlights can only emit light from their central parts, which may turn out to be inconvenient under some situations.

SUMMARY

The present disclosure provides a downlight, comprising: a back cover; light source components, provided on an aluminum substrate; a surface ring, which is a transparent supporting component and supports the aluminum substrate so that the aluminum substrate can be fixed to the back cover, and is fastened to the back cover; a light diffusing cover, mounted on a bottom of the surface ring for transmitting light emitted from the light source components.

In an embodiment of the present disclosure, the surface ring comprises a upper part that is a truncated cone structure, and a lower part that is a ring-shaped panel; a top of the surface ring is a top of the truncated cone structure; an inner side of the ring-shaped panel is connected with a bottom of the truncated cone structure, and the ring-shaped panel and the truncated cone structure are formed in one piece.

In an embodiment of the present disclosure, the light source components further comprise main illuminating LEDs and ambient illuminating LEDs. The downlight further includes a reflective plate, which is positioned between the surface ring and the light diffusing cover, for isolating illumination areas of the main illuminating LEDs from illumination areas of the ambient illuminating LEDs.

In an embodiment of the present disclosure, the main illuminating LEDs are provided in a central portion of the aluminum substrate, and the ambient illuminating LEDs are provided in an outer ring of the aluminum substrate, the outer ring surrounding the central portion; or some of the main illuminating LEDs are provided on the central portion of the aluminum substrate, and the rest of the main illuminating LEDs and all the ambient illuminating LEDs are provided on the outer ring of the aluminum substrate; or some of the main illuminating LEDs and some of the ambient illuminating LEDs are provided on the central portion of the aluminum substrate, and the rest of the main illuminating LEDs and the rest of the ambient illuminating LEDs are provided on the outer ring of the aluminum substrate.

In an embodiment of the present disclosure, the downlight further comprises a control circuit board, which is electrically connected to the light source components for respectively controlling the main illuminating LEDs and the ambient illuminating LEDs to emit light, or for synchronously controlling both the main illuminating LEDs and the ambient illuminating LEDs to emit light.

In an embodiment of the present disclosure, a top surface of the surface ring is connected to the aluminum substrate; some of the light source components are located inside the surface ring, and the rest outside of the surface ring, wherein light emitted by the light source components inside the surface ring is transmitted through the light diffusing cover, and the light emitted by the light source components located outside the surface ring refracts into the surface ring and is reflected and transmitted inside the surface ring so as to be finally transmitted out through the ring-shaped panel.

In an embodiment of the present disclosure, a top surface of the surface ring is connected to the light source components; light emitted by the light source components located inside the surface ring is transmitted through the light diffusing cover; light emitted by the light source components located outside the surface ring is directly emitted into the surface ring and is reflected and transmitted inside the surface ring, so as to be finally transmitted out through the ring-shaped panel of the surface ring.

In an embodiment of the present disclosure, sides or/and a bottom surface of the surface ring are engraved with one or more patterns.

In an embodiment of the present disclosure, the surface ring is fastened to the back cover by screws; the surface ring is provided with one or more screw holes for mounting the screws.

In an embodiment of the present disclosure, the back cover is provided with a fastening structure for fixing a resilient structure, and the resilient structure comprises a replaceable spring or a spring that is fixedly installed.

The downlight described in the present disclosure has the following beneficial effects:

In the downlight of the present disclosure, light is transmitted to a ring-shaped panel at the bottom of the surface ring through a truncated cone structure of the surface ring, and is then transmitted out of the ring-shaped panel, to achieve light emission with a new angle, solving the problem in conventional downlights that, light can only be emitted from a single angle; The present disclosure improves the angle of light emission from the light source while also improving its light emission effect.

A variety of modes of ambient illumination can be obtained using the downlight of the present disclosure, further enhancing the downlight's capability to create certain atmosphere, making it easier for users to adjust the atmosphere, and enhancing the user experience.

REFERENCE NUMERALS

Figure 1:
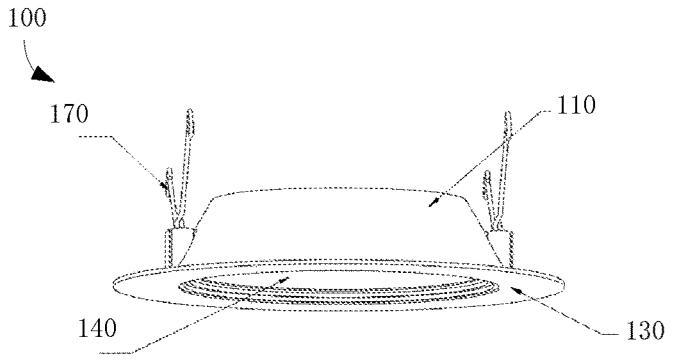
FIG. 1 shows a schematic diagram of a downlight according to an embodiment of the present disclosure.

100 Downlight
110 Back cover
120 Light source components
121 Main illuminating LEDs
122 Ambient illuminating LEDs
130 Surface ring
131 Truncated cone structure
132 Ring-shaped panel
140 Diffusing cover
150 Aluminum substrate
160 Reflective plate
170 Resilient structure

DETAILED DESCRIPTION

The following describes the implementation of the present disclosure through specific examples, and those skilled in the art can easily understand other advantages and effects of the present disclosure from the content disclosed in this specification. The present disclosure can also be implemented or applied through other different specific embodiments. Various details in this specification can also be modified or changed based on different viewpoints and applications without departing from the spirit of the present disclosure. It should be noted that the following embodiments and the features in the embodiments can be combined with each other if no conflict will result.

It should be noted that the drawings provided in this disclosure only illustrate the basic concept of the present disclosure in a schematic way, so the drawings only show the components related to the present disclosure. The drawings are not necessarily drawn according to the number, shape and size of the components in actual implementation; during the actual implementation, the type, quantity and proportion of each component can be changed as needed, and the components' layout can also be more complicated. In the accompanying drawings and following description, the terms "proximal", "lower", and "bottom" refer to a position close to a substance receiving the light from the downlight, and the term "distal", "upper", and "top" refers to a position away from a substance receiving the light from the downlight.

Referring to FIG. 1, the present disclosure provides a downlight, and the downlight 100 includes: a back cover 110, light source components 120, a surface ring 130, and a light diffusing cover 140.

The back cover 110 serves as a base for carrying the downlight and is used for matching and connecting with a lamp holder embedded in the ceiling, and connecting to the power supply. The light source components 120 are set on an aluminum substrate 150 for emitting light when powered on. The surface ring 130 is a transparent supporting component to support the aluminum substrate 150 so that the aluminum substrate is 150 fixed to the back cover, and the surface ring 130 is fastened to the back cover. The light diffusing cover 140 is mounted on the bottom (proximal end) of the surface ring 130 for transmitting the light emitted by the light source components.

Further, the surface ring 130 may be provided with a mounting slot for mounting the light diffusing cover 140. The surface ring 130 may also be provided with other means for mounting the light diffusing cover 140.

The surface ring described in the present disclosure is made of transparent materials in one-piece, and has two functions:

First, because its materials are transparent and can transmit light, the surface ring allows light to be emitted at more angles. In contrast, traditional downlights have only a single angle when it comes to light emission. In the downlight described in the present disclosure, light can not only be transmitted downward through the light diffusing cover 140, but also be guided through the surface ring 130 surrounding the light diffusing cover 140.

Secondly, because of its structural design, the surface ring can also support the aluminum substrate 150 so that the aluminum substrate 150 can be fixed in the back cover and the surface ring 130 can be fastened to the back cover.

Figure 2:
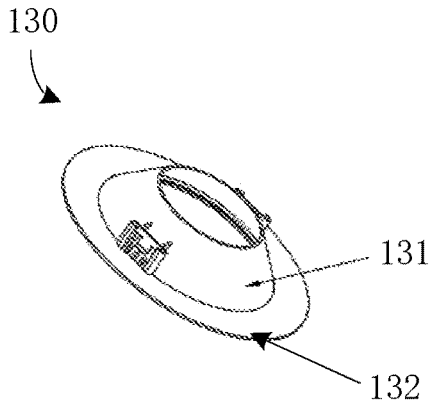
FIG. 2 shows a schematic diagram of a surface ring of a downlight according to an embodiment of the present disclosure.

Referring to FIG. 2, in an embodiment of the present disclosure, the surface ring 130 comprises a upper part that is a truncated cone structure 131, and a lower part that is a ring-shaped panel 132. A top of the surface ring 130 is a top of the truncated cone structure 31; an inner side of the ring-shaped panel 132 is connected with a bottom of the truncated cone structure 131, and the ring-shaped panel 132 and the truncated cone structure 131 are formed in one piece.

In the downlight of the present disclosure, light is transmitted to a ring-shaped panel in the bottom of the surface ring through a truncated cone structure of the surface ring, and is then transmitted out of the ring-shaped panel, to achieve light emission with a new angle, solving the problem that in conventional downlights, light can only be emitted from a single angle. The present disclosure improves the angle of light emission from the light source while also improving its light emission effect.

In an embodiment of the present disclosure, sides or/and a bottom surface of the surface ring are engraved with one or more patterns, which further enriches the atmosphere created by the downlight.

Figure 3A:
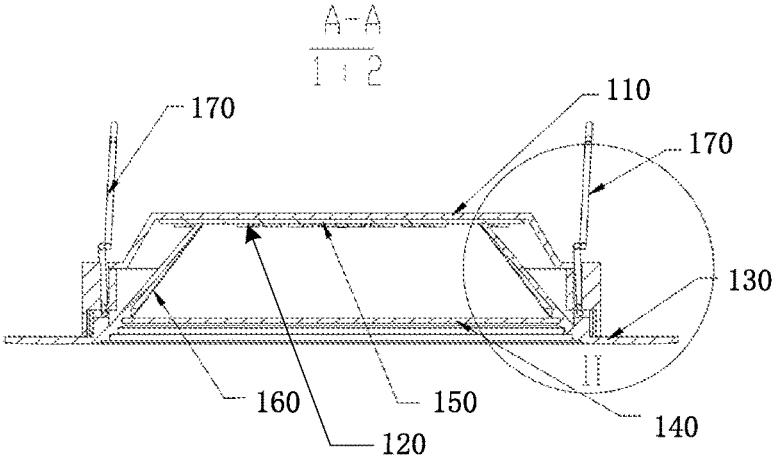
FIG. 3A shows a schematic diagram of structures of a downlight relating to light transmission according to an embodiment of the present disclosure.
Figure 3B:
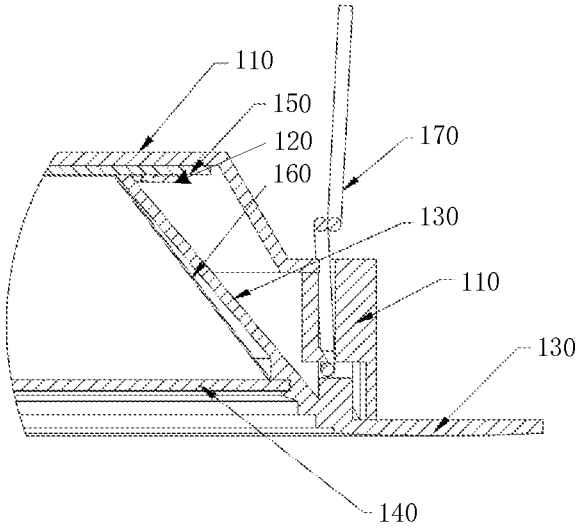
FIG. 3B is a partially enlarged view of FIG. 3A.

Referring to FIG. 3A and FIG. 3B, in an embodiment of the present disclosure, a top surface of the surface ring 130 is connected to the aluminum substrate 150; some of the light source components are located inside the surface ring 130, meaning they are located in the space encircled by the truncated cone structure of the surface ring, and the rest outside of the surface ring 130, meaning they are located outside the space encircled by the truncated cone structure;

wherein light emitted by the light source components inside the surface ring is transmitted through the light diffusing cover 140, and the light emitted by the light source components located outside the surface ring 130 refracts into the surface ring and is reflected and transmitted inside the surface ring 130, so as to be finally transmitted out through the ring-shaped panel. That is, the light emitted by the light source components located on the outer side of the surface ring 130 is refracted from outside of the truncated cone structure 131 into the truncated cone structure 131, and is then reflected and transmitted inside the truncated cone structure 131 until reaching the ring-shaped panel 132 at the bottom of the surface ring 130, where the light is finally emitted out of the downlight through the ring-shaped panel 132.

Figure 3C:
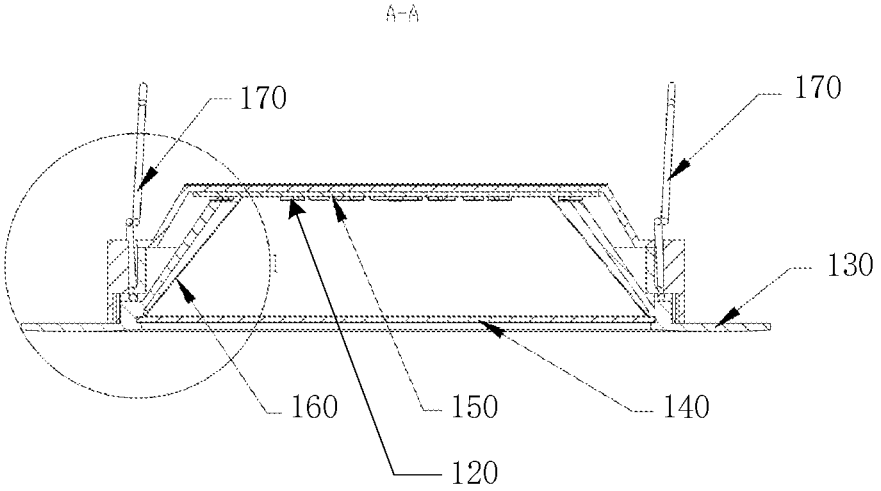
FIG. 3C shows a schematic diagram of structures of a downlight relating to light transmission according to an embodiment of the present disclosure.
Figure 3D:
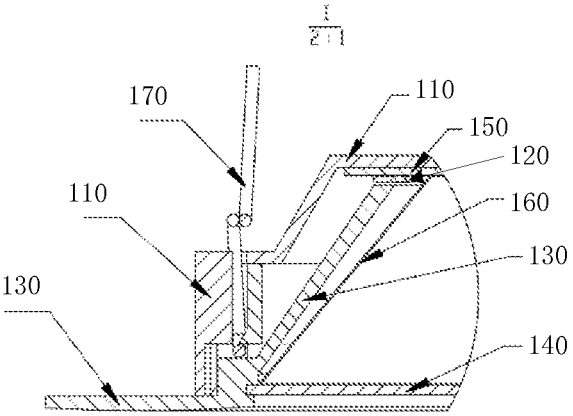
FIG. 3D is a partially enlarged view of FIG. 3C.

Referring to FIG. 3C and FIG. 3D, in an embodiment of the present disclosure, a top surface of the surface ring 130 is connected to the light source components 120; light emitted by the light source components located inside the surface ring is transmitted through the light diffusing cover; light emitted by the light source components located outside the surface ring is directly emitted into the surface ring and is reflected and transmitted inside the surface ring so as to be finally transmitted out through the ring-shaped panel of the surface ring. That is, the light emitted by the light source components located outside of the surface ring 130 directly goes through the top surface of the truncated cone structure 131 into the truncated cone structure 131, and is then reflected and transmitted inside the truncated cone structure 131 until reaching the ring-shaped panel 132 at the bottom of the surface ring 130, where the light is finally emitted out of the downlight through the ring-shaped panel 132.

Figure 4:
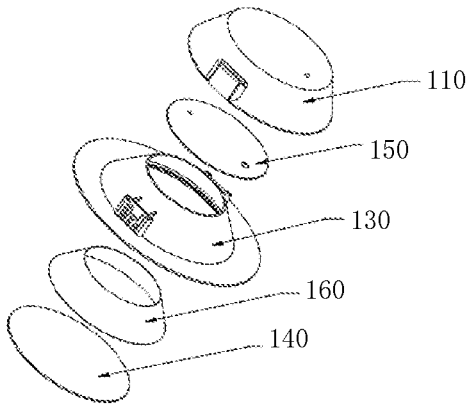
FIG. 4 shows a schematic diagram of a downlight according to an embodiment of the present disclosure.

Referring to FIG. 4, in an embodiment of the present disclosure, the downlight 100 further comprises a reflective plate 160. The reflective plate 160 is positioned between the surface ring 130 and the light diffusing cover 140, and isolates illumination areas of main illuminating LEDs 121 from illumination areas of ambient illuminating LEDs 122.

The present disclosure uses the reflective plate to isolate the illumination areas of the main illuminating LEDs from the illumination areas of the ambient illuminating LEDs in order to enhance the effect of ambient illumination.

Figure 5A:
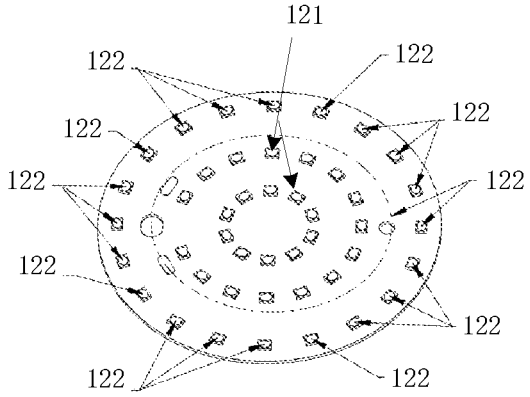
FIG. 5A shows a schematic diagram of light source components of a downlight according to a first embodiment of the present disclosure.

Referring to FIG. 5A, in an embodiment of the present disclosure, the main illuminating LEDs are provided in a central portion of the aluminum substrate, and the ambient illuminating LEDs are provided in an outer ring of the aluminum substrate, wherein the outer ring surrounds the central portion.

Figure 5B:
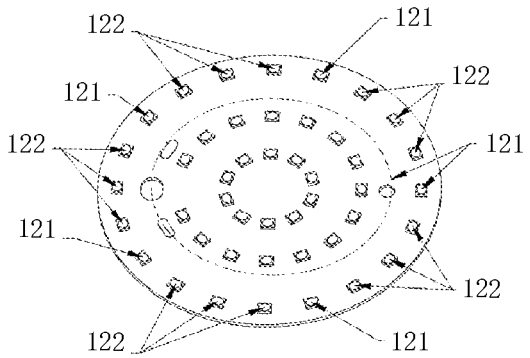
FIG. 5B shows a schematic diagram of light source components of a downlight according to a second embodiment of the present disclosure.

Referring to FIG. 5B, in an embodiment of the present disclosure, some of the main illuminating LEDs are provided on the central portion of the aluminum substrate, and the rest of the main illuminating LEDs and all the ambient illuminating LEDs are provided on the outer ring of the aluminum substrate.

Figure 5C:
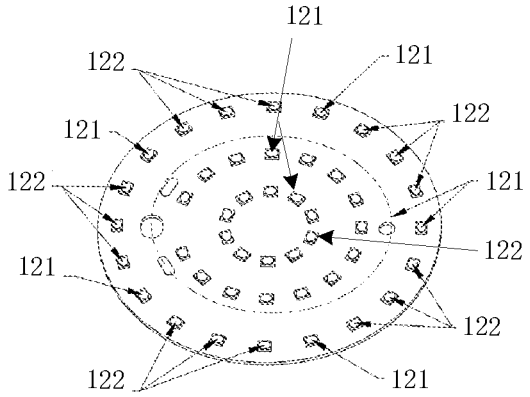
FIG. 5C shows a schematic diagram of light source components of a downlight according to a third embodiment of the present disclosure.

Referring to FIG. 5C, in an embodiment of the present disclosure, some of the main illuminating LEDs and some of the ambient illuminating LEDs are provided on the central portion of the aluminum substrate, and the rest of the main illuminating LEDs and the rest of the ambient illuminating LEDs are provided on the outer ring of the aluminum substrate.

In an embodiment of the present disclosure, the downlight 100 further comprises a control circuit board (not shown). The control circuit board is electrically connected to the light source components 120 for respectively controlling the main illuminating LEDs and the ambient illuminating LEDs to emit light, or for synchronously controlling both the main illuminating LEDs and the ambient illuminating LEDs to emit light. The control circuit board adopts conventional methods for controlling the main illuminating LEDs and ambient illuminating LEDs.

The main illuminating LEDs and the ambient illuminating LEDs may have the same color or different colors. When the main illuminating LEDs are on, the ambient illuminating LEDs can also be on or off. Through different layout as shown in FIG. 5A to FIG. 5C, and various potential ways of the control circuit board to control the lighting of the main illuminating LEDs and the ambient illuminating LEDs, a variety of modes of ambient illumination can be obtained, further enhancing the downlight's capability to create various atmospheres, making it easier for users to adjust the atmospheres, and enhancing the user experience.

In an embodiment of the present disclosure, referring to FIG. 1, the surface ring 130 is fastened to the back cover 110 by screws; the surface ring is provided with one or more screw holes for mounting the screws. The back cover is provided with a fastening structure for fixing a resilient structure 170.

Further, the resilient structure 170 may be a spring. The back cover is formed in one-piece and may be provided with a limiting hole (i.e., a fastening structure) for mounting the spring. The surface ring is made of transparent materials and made in one-piece; the surface ring and the back cover are fastened together by four screws positioned where the spring is mounted, and the top of the surface ring abuts against a light source plate (i.e., aluminum substrate 150). The spring can be fixed by directly inserting it into the limiting hole.

Figure 6A:
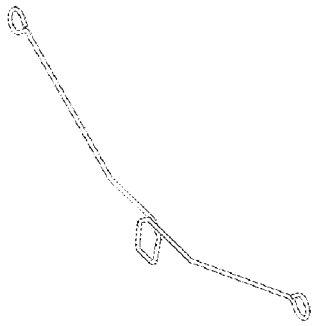
FIG. 6A shows a schematic diagram of a flexible component of a downlight according to an embodiment of the present disclosure.
Figure 6B:
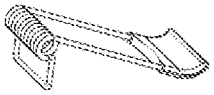
FIG. 6B shows a schematic diagram of a flexible component of a downlight according to an embodiment of the present disclosure.

Referring to FIG. 6A, the resilient structure may be a replaceable spring. Referring to FIG. 6B, the resilient structure may be a spring that is fixedly installed.

The downlight described in the present disclosure has the function of ambient illumination, and the part that transmits and guides ambient light is the surface ring, which is also a supporting part of the downlight. The surface ring is simple in structure and is easy to be assembled; the outer surface of the surface ring can be customized with a pattern. In addition, the ambient illuminating LEDS and the main illuminating LEDs are installed on the same component (i.e. the aluminum substrate), and they all adopt a direct-light-emitting mode; with this integrated design, the downlight is easier to manufacture; the direct-light-emitting mode has a higher efficiency. In an ambient illumination mode, light for ambient illumination comes through the surface ring; the surface ring and the light diffusing cover are separated by an opaque reflective plate with a high reflectivity, so that when the downlight is in the ambient illumination mode, there is no light coming through the light diffusing cover, and there is obvious contrast of light and dark between the surface ring and the light diffusing cover. In one embodiment, there are some main illuminating LEDs outside of the surface ring, and as a result, in a main illumination mode, the surface ring shimmers, and the light diffusing cover emits stronger light. The control circuit board may respectively control the main illuminating LEDs and the ambient illuminating LEDs to emit light, or synchronously control both the main illuminating LEDs and the ambient illuminating LEDs to emit light. The downlight in the present disclosure can achieve ambient illumination, and the brightness and color temperature of the ambient illumination can be adjusted, with a variety of changes available to adapt to a variety of scenarios. The ambient illuminating LEDs described in the present disclosure and the main illuminating LEDs can have the same or different colors, and their colors may be changed to adapt to a variety of scenarios. In one embodiment, the ambient illuminating LEDs and the main illuminating LEDs are separated by an opaque part (reflective plate) so that the two illumination modes have a clear border. In one embodiment, the spring is mounted directly on the surface ring. In one embodiment, the spring is removable and replaceable, which makes it compatible with installation in different environments.

In actual implantation, the structure of the downlight may be different than those described in the present disclosure, and any structural changes made according to the principles of the present disclosure are included in the scope of the present disclosure.

In summary, the present disclosure effectively overcomes the shortcomings of the prior art and has a high industrial value.

The above embodiments are only illustrative of the principles of the present disclosure and its effectiveness, and are not intended to limit the scope of the present disclosure. Any person skilled in the art may modify or change the above embodiments without violating the spirit and scope of the present disclosure. Therefore, all equivalent modifications or changes made by a person having ordinary knowledge in the art, without departing from the spirit and technical ideas disclosed in the present disclosure, shall still be covered by the attached claims of the present disclosure.

What is claimed is:

1. A downlight, comprising:

a back cover;

light source components, provided on an aluminum substrate;

a surface ring, wherein the surface ring is a supporting component made of transparent materials, supports the aluminum substrate so that the aluminum substrate is fixed to the back cover, wherein the surface ring is fastened to the back cover, wherein the surface ring comprises a lower part that is a ring-shaped panel; and a light diffusing cover, mounted on a bottom of the surface ring for transmitting the light emitted by the light source components, wherein light emitted by the light source components located inside the surface ring is transmitted through the light diffusing cover; light emitted by the light source components located outside the surface ring is directly emitted into the surface ring and is reflected and transmitted inside the transparent materials of the surface ring, so as to be finally transmitted through the ring-shaped panel of the surface ring.

2. The downlight according to claim 1, wherein the surface ring comprises a upper part that is a truncated cone structure; a top of the surface ring is a top of the truncated cone structure; an inner side of the ring-shaped panel is connected with a bottom of the truncated cone structure, and the ring-shaped panel and the truncated cone structure are formed in one piece.

3. The downlight according to claim 1, wherein the downlight further comprises a reflective plate, which is positioned between the surface ring and the light diffusing cover;

wherein the light source components further comprise main illuminating LEDs and ambient illuminating LEDs, and the reflective plate isolates illumination areas of the main illuminating LEDs from illumination areas of the ambient illuminating LEDs.

4. The downlight according to claim 3, wherein the aluminum substrate comprises an outer ring and a central portion;

wherein the main illuminating LEDs are provided on the central portion of the aluminum substrate and the ambient illuminating LEDs are provided on the outer ring of the aluminum substrate, or some of the main illuminating LEDs are provided on the central portion of the aluminum substrate, and the rest of the main illuminating LEDs and all the ambient illuminating LEDs are provided on the outer ring of the aluminum substrate; or some of the main illuminating LEDs and some of the ambient illuminating LEDs are provided on the central portion of the aluminum substrate, and the rest of the main illuminating LEDs and the rest of the ambient illuminating LEDs are provided on the outer ring of the aluminum substrate.

5. The downlight according to claim 3, wherein the downlight further comprises:

a control circuit board, electrically connected to the light source components, for respectively controlling the main illuminating LEDs and the ambient illuminating LEDs to emit light.

6. The downlight according to claim 1, wherein a top surface of the surface ring is connected to the aluminum substrate; wherein some of the light source components are located inside the surface ring, and the rest of the light source components are located outside of the surface ring.

7. The downlight according to claim 1, wherein a top surface of the surface ring is connected to the light source components.

8. The downlight according to claim 1, wherein the surface ring has one or more patterns engraved on a side or/and a bottom surface of the surface ring.

9. The downlight according to claim 1, wherein the surface ring is fastened to the back cover by one or more screws, and the surface ring is provided with one or more screw holes for mounting the screws.

10. The downlight according to claim 9, wherein the back cover is provided with a fastening structure for fixing a resilient structure, and the resilient structure comprises a replaceable spring or a spring that is fixedly installed.

11. The downlight according to claim 1, wherein the ring-shaped panel and the light diffusing cover are in the same plane.

* * * * *